US005294197A

United States Patent [19]

Prill et al.

[11] Patent Number: 5,294,197

[45] Date of Patent: Mar. 15, 1994

[54] ASPHALT MANUFACTURING ASSEMBLY

[75] Inventors: Fredric W. Prill, North Aurora; Robert E. Farnham, Naperville, both of Ill.

[73] Assignee: Asphalt Product Technologies, Geneva, Ill.

[21] Appl. No.: 604,962

[22] Filed: Oct. 29, 1990

[51] Int. Cl.[5] ..... B28C 5/46

[52] U.S. Cl. ..... 366/22; 366/14; 366/23

[58] Field of Search ..... 366/22, 23, 24, 25, 366/7, 144, 147, 6, 14, 220; 426/433

[56] References Cited

U.S. PATENT DOCUMENTS 4,946,283 8/1990 Musil ..... 366/25

*Primary Examiner*—Robert W. Jenkins

*Attorney, Agent, or Firm*—Wallenstein Wagner & Hattis, Ltd.

[57] ABSTRACT

An asphalt manufacturing assembly (10) is disclosed that includes a rotatable cylindrical dryer drum (11) having an opening (14) in the front (12) for receiving virgin asphalt aggregate and for permitting the exhaust of fumes and an opening (18) in the back (13) for discharging the heated aggregate and for permitting the introduction of air. A burner (41) adjacent the back (13) introduces a flame and heat into the dryer drum (11). A longitudinal air conduit (22) is formed by a stationary annular shroud (20) around the back portion of the dryer drum (11) that extends longitudinally beyond the dryer drum back end (13). The shroud (20) includes two controllable discharge openings (24,25). The assembly (10) further includes a separate rotatable cylindrical mixer drum (51) having a materials inlet (54) for receiving the aggregate discharged from the dryer drum (11), reclaimed asphalt pavement, liquid asphalt and fines and a discharge opening (58) for discharging asphalt. A scavenger fan (95) is disposed generally between the two drums (11,51). Each drum (11,51) further includes a plurality of longitudinally and radially projecting paddles (28,32) attached to each's back end (13,53).

21 Claims, 2 Drawing Sheets

ASPHALT MANUFACTURING ASSEMBLY

TECHNICAL FIELD

The present invention relates to asphalt production and, more particularly, to an improved assembly for manufacturing asphalt that is both energy efficient and easier to use and maintain.

BACKGROUND PRIOR ART

Asphalt is typically produced by heat drying virgin asphalt aggregate and by adding to it and mixing with it liquid asphalt cement, fillers and other additives, often including recycled asphalt pavement. Often times, asphalt is also made by drying virgin asphalt aggregate and moving it to a batch plant tower for batch mixing with the asphalt and other additives.

Prior art systems, such as the one disclosed in U.S. Pat. No. 4,892,411, entitled ASPHALT MIXER APPARATUS AND METHOD, disclose counterflow Drum Mix type systems. In these systems, the plants produce either a mixture of recycled asphalt and virgin materials or of virgin materials only. Two concentric drums, one being for drying the materials and one being for mixing the materials, are used. Aggregates are put into the first, drying rotating drum and the materials move in a direction toward the second, mixing rotating drum. A burner is mounted behind the second drum and extends through this drum to the first drum for directing a flame into the first drum. The materials moving in the first drum move towards the flame and under the influence of the heat are dried. The aggregate then moves into the second drum which mixes it with liquid asphalt, fines and recycled asphalt materials. Although such a system produces asphalt products, it and others can be inefficient and damaging on equipment. For example, by having the burner extend through the second cylinder, the mixing chamber must be extremely large. And, the added size requires more power to drive. Further, by having the drums abutting one another, access to the inlet opening of the second, mixer drum is difficult. Thus, repairs and monitoring, and even the introduction of materials, can be difficult. Further, this arrangement requires the modification of a standard industrial burner, such as by attachment of an extension, to reach into the first cylinder.

SUMMARY OF THE INVENTION

The assembly of the present invention permits one to efficiently make quality asphalt products with or without reclaimed asphalt components.

The asphalt manufacturing assembly of the present invention includes a first and a second rotatable cylindrical drum. Each drum has a front end and a back end and further has internal flights to said in the lifting, dropping, mixing and moving of the materials within the drum. The first cylinder, which is for drying virgin asphalt aggregate, has external circumferential tracks, often called tires or support rings, that contact rotating trunnions. The second, separate cylinder, which is for mixing the aggregate, liquid asphalt, fines and reclaimed asphalt product, if any, is supported by and rotated about an internal shaft having support bearings at each end. This second drum can be driven by a small motor and chain system. As both cylinders are rotated the contents of each mix as they pass therethrough from the front end towards the back end. Both cylinders may be sloped downwardly towards the back end or discharge.

Asphalt aggregate is introduced into the first cylinder through an inlet opening in the front end by a conveyer. The aggregate is lifted and dropped inside the first cylinder and moved by angled internal flights and by gravity to the opposite end where there is a discharge opening. Preferably, there is an industrial burner at the discharge end of the first cylinder which produces heat and a flame. This burner has an attached blower at one end and an attached nozzle at the other end. Accordingly, the burner directs a flame in a direction counter to or opposite the flow of the cylinder's contents. A stationary, annular shroud having a generally closed back end is placed around a portion, the back portion, of the first cylinder, forming an air passage between the internal surface of the shroud and the generally open external surface of the cylinder so that air can be brought into this first cylinder for the burner. This shroud extends longitudinally beyond the generally open back end of the cylinder.

A plurality of paddles connected to the back of the first cylinder rotate with the first cylinder and move the hot aggregate that has fallen out of and has been discharged from the first cylinder into one of two controllable openings in the bottom of the shroud. One opening leads to a storage facility or to a conventional asphalt batch plant; and, the other opening leads to a hopper which channels the aggregate to the second cylinder.

The second cylinder receives the hot, dry aggregate from the first cylinder through an opening in its front end. Liquid asphalt and fines are then introduced into the second cylinder through conduits that pass through this opening in the front end. Reclaimed asphalt pavement can also be introduced into the second cylinder via the hopper and channel used for the dry aggregate. The entire contents of the second cylinder are then lifted, dropped and mixed within the cylinder a they move generally from the cylinder front to its back. The second cylinder includes internal flights and can also be sloped downwardly toward the back end to permit the contents to move towards the discharge. The final asphalt product or mix exits out of the second cylinder in the back end, which is generally open, where its falls into an end housing. Paddles connected to the end of the second cylinder rotate with the second cylinder and move the hot mixture into a discharge opening. Once the mixture clears through the discharge opening, it is taken away for storage or immediate use.

A conduit system is disposed between the cylinders for drawing off smoke, steam and particles discharged from the back end of the second cylinder and for feeding the smoke, steam and dust particles into the back end of the first cylinder and into the flame where they are incinerated. A scavenger fan may be used to augment the draft of the burner in drawing off the fumes.

Other advantages and aspects of the present invention will become apparent upon reading the following description of the drawings and detailed description of the invention.

DETAILED DESCRIPTION

Figure 1:
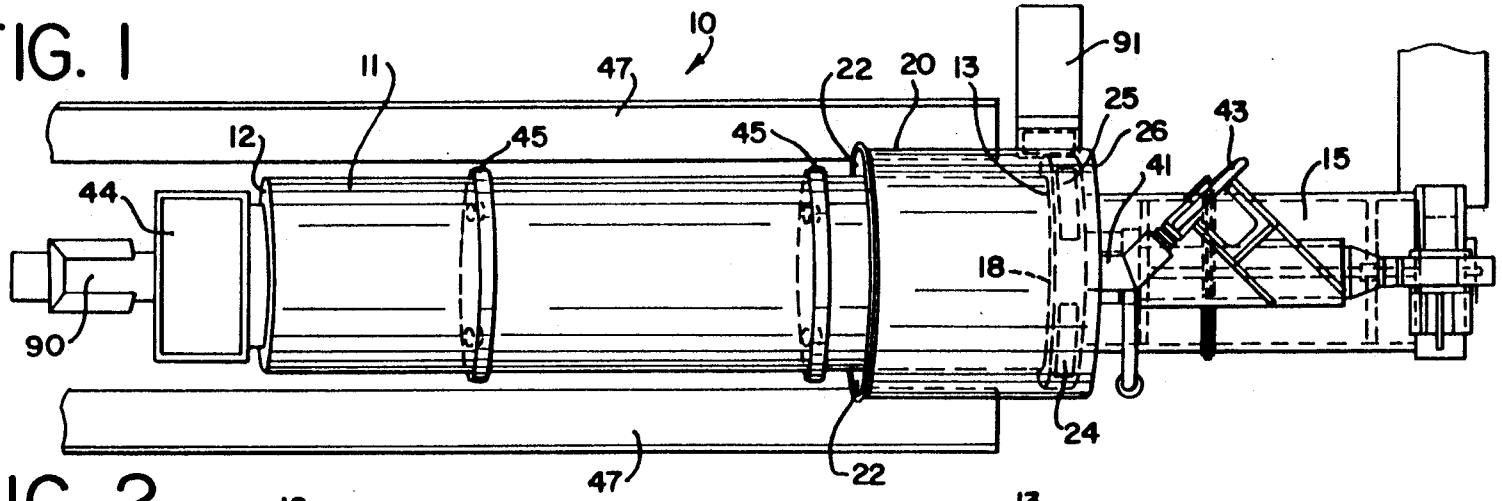
FIG. 1 is a top plan view of the asphalt manufacturing assembly made in accordance with the teachings of the present invention.

While this invention is susceptible of embodiment in many different forms, there is shown in the drawings and will herein be described in detail a preferred embodiment of the invention with the understanding that the present disclosure is to be considered as an exemplification of the principles of the invention, and is not intended to limit the broad aspect of the invention to embodiment illustrated.

The asphalt manufacturing assembly of the present invention, designated by the reference numeral 10, is generally shown in FIG. 1. There are two primary, separate components of the assembly 10 which are the dryer drum 11 and mixer drum 51. The dryer drum 11 is for drying the asphalt aggregate introduced into the system and the mixer drum 51 is to mix the various components used for making the final asphalt product.

The dryer drum 11 is both rotatable and cylindrical in shape and has a front end 12 and a generally open back end 13. As shown more completely in FIG. 2, the virgin asphalt aggregate is introduced into the mixer drum 11 through a front opening 14 in the front end 12. This front inlet 14 is fed the virgin aggregate by a feed conveyer 90. A plurality of flights 15 abut the interior of the drum 11 so that while the drum rotates the flights 15 lift and drop the aggregate through the hot gases passing through the drum. Accordingly, by this action, the aggregate moves within this drum. Projecting into the generally open back end 13 of the dryer drum 11 is an industrial burner 41 which has a nozzle 42 secured to one end and a burner blower 43 secured to the other end. The nozzle 42 protrudes into the back end 13 and into the interior of the dryer drum 11. A generally cylindrical housing 48 is positioned adjacent to and partially around the nozzle 42 to aid in the combustion.

Thus, when the industrial burner 41 and burner blower 43 are activated, a hot flame is injected through the cylindrical housing 48 and introduced into the interior of the dryer drum 11. Preferably the resulting flame heats the aggregate in the dryer drum 11 to temperatures from ambient or about 70 degrees in the aggregate inlet zone 16, being that portion of the drum 11 interior furthest from the flame and closest to the front opening 14, to about 300 to 900 degrees in the combustion zone 17, being that interior portion in which the flame is burning. The temperature to which the aggregate is heated depends on the type of mix that is to be produced and on the amount, if any, of reclaimed asphalt pavement to be added to the mix. The flow of aggregate within the dryer drum 11 is preferably against the flame produced by the burner 41, namely, a counterflow motion.

The flame being injected through the nozzle 42 by the blower 43 from the burner 41 not only heats and drys the contents of the dryer drum 11, but creates gaseous products of combustion and steam. The flow of hot gases created by the burner 41 also carries smaller and lighter particles of dry aggregate, commonly referred to as dust or as fines. An exhaust outlet 44 is provided at the front end 12 of the dryer 11 to carry the products of combustion, steam and entrained fines to a dust collector (not shown), which separates and reclaims the fines. This action is to prevent air pollution. The dust collector can also include a fan (not shown) which provides the draft necessary to support combustion.

The dryer drum 11 further includes a plurality of circumferential tracks 45 fixedly secured to the exterior thereof. A plurality of trunnions 46 that are freely rotatable and are secured to a frame support structure 47 contact these circumferential tracks 45. One or more of these trunnions 46 can be coupled with a motor for rotating the entire drum 11. Preferably, in the illustrated embodiment, there are two opposed trunnions 46 for each circumferential track 45. Further, preferably, the trunnions 46 and frame 47 are positioned so that the dryer drum 11, which is supported thereby, is tilted downwardly and rearwardly such that the front end 12 is higher than the back end 13. Thus, when the dryer drum 11 is rotated on the trunnions 46, the virgin aggregate within the drum is lifted, dropped, heated, dried and moved rearwardly in the drum.

In order for the industrial burner 41 to sustain the flame and resultant heat, air must be introduced into the dryer drum 11 at the combustion zone 17. This can be accomplished by positioning an annular shroud 20 around the back portion of the dryer drum 11. In particular, a stationary shroud 20 having a circumference greater than that of the dryer drum 11, is positioned around the back portion of the rotating drum 11. The shroud 20 extends longitudinally beyond the generally open end 13 (opening 18) of the dryer drum 11. The shroud 20 has a generally closed back end 26. While it is appreciated that the shroud 20 can encircle the entire dryer drum 11 and even rotate with the dryer drum, it has been found that it is preferable to keep the shroud stationary and covers only a portion of the drum. Consequently, a longitudinal air conduit 22 is formed by the space between the exterior of the dryer drum 11 and the interior of the shroud 20. The generally open back end 13 (back opening 18) of the drum 11 permits entry of the air into the drum. Thus, while the air passes over the exterior of the dryer drum 11 on its way into the drum, it cools the dryer drum which is made of metal. This action can prevent deterioration of the dryer's metal walls. Also, this action preheats the combustion air, resulting in lower heat loss and increased efficiency. Moreover, by having the shroud 20 encircling the drum and by having the air pass therebetween, heat is prevented from reaching workmen positioned near the drum and from damaging electrical cables or other valuable equipment near the drum.

An opening 27 is provided in the back end 26 of the shroud to permit the burner assembly 41 therethrough.

Once the heated aggregate moves completely rearwardly in the dryer drum 11, it falls out of the drum through the back opening 18 in the dryer drum onto the shroud's inner surface 20.

Figure 3:
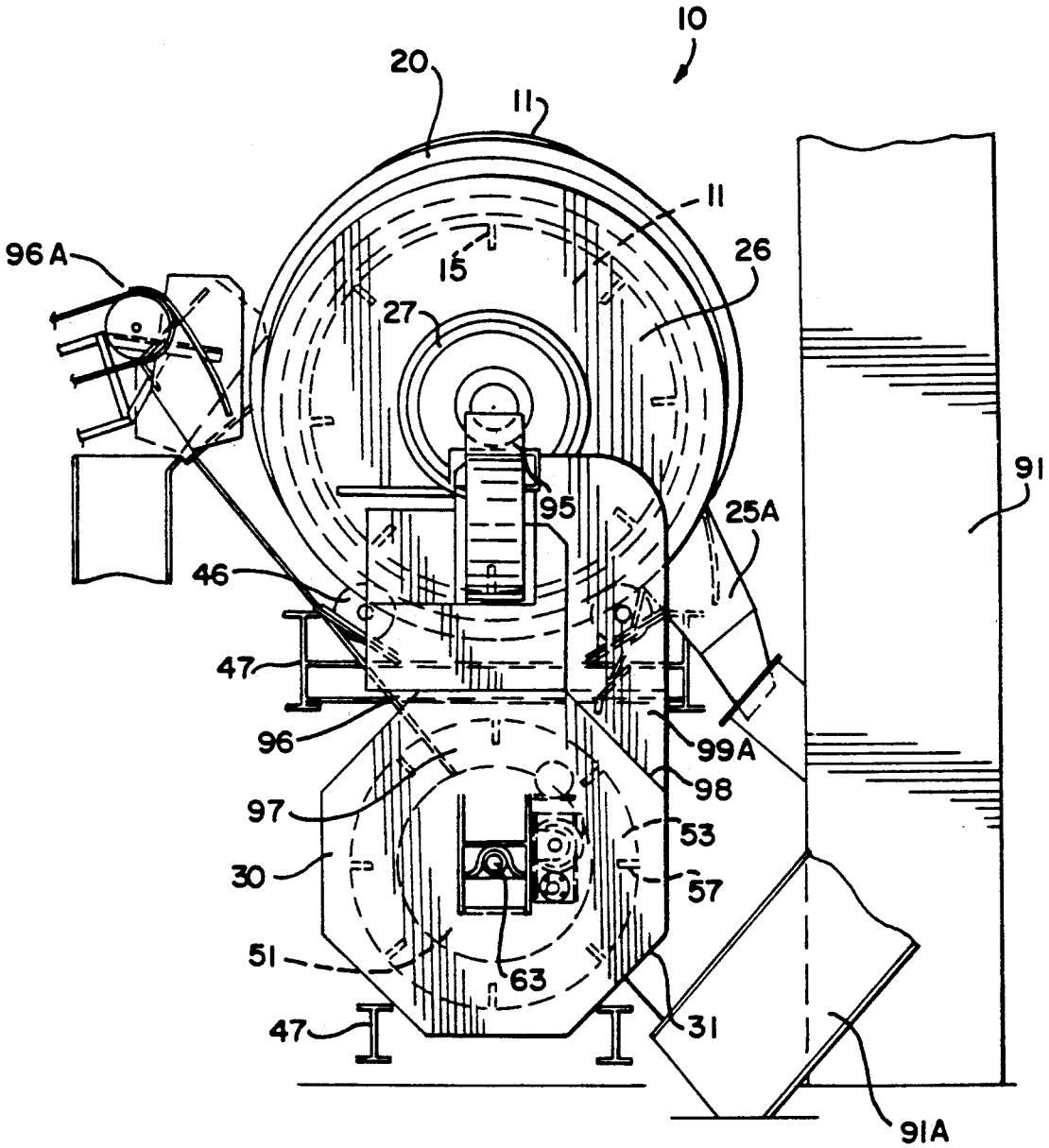

A first discharge opening 24 (FIG. 1) is provided in the bottom portion of the shroud 20 near the back end 26 of the shroud for discharging the heated asphalt aggregate into a hopper 96 which funnels the materials to a channel 97 which leads to the mixer drum 51. However, at times it is desired to transfer the heated asphalt aggregate to a batch plant for batch mixing or to a separate storage bin for further use at a later time. For such occasions, a second discharge opening 25 (FIG. 1) is also provided in the bottom portion of the shroud 20 near the back end 26 of the shroud. The heated aggregate is discharged through this second discharge opening 25 into a chute 25A (FIG. 3) into an elevator 91 which transports it to the batch plant. Both discharge openings 24,25 are controllable by conventional means such as gates with air cylinders so that the operator can open and close both of them. Consequently, one can open either the first discharge 24 or the second discharge 25.

Figure 2:
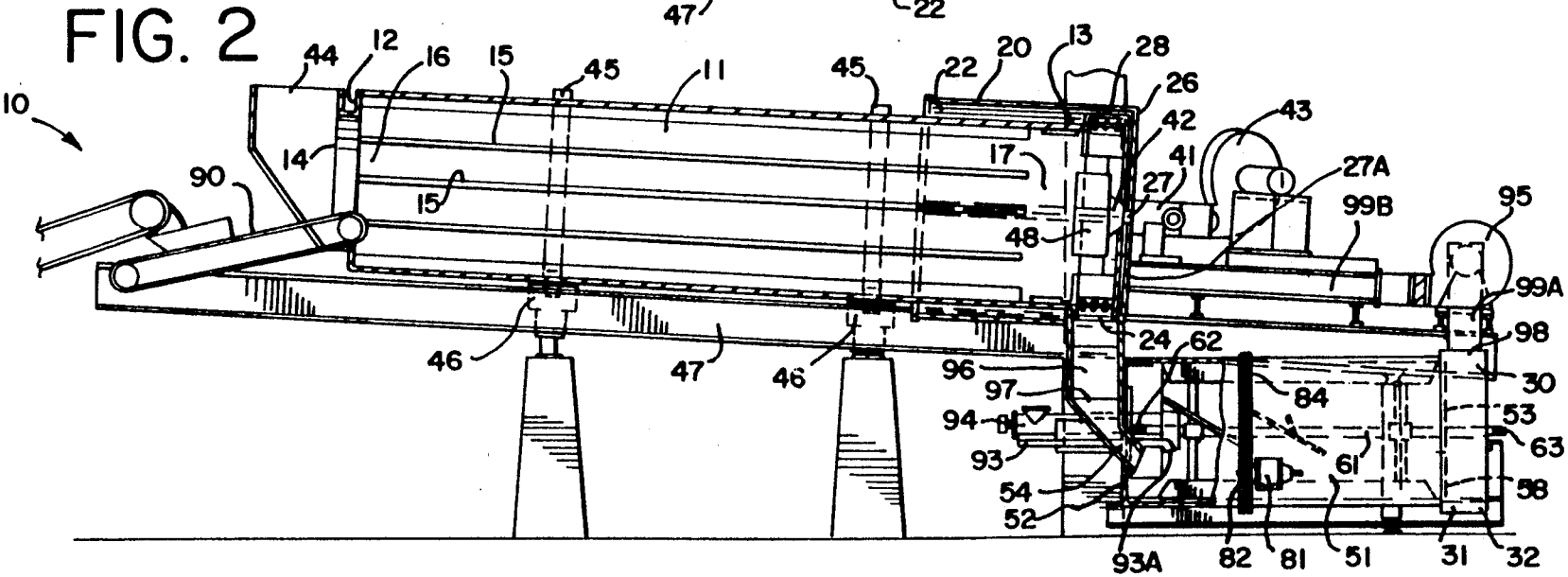
FIG. 2 is a side elevation view of the asphalt manufacturing assembly with a partial sectional view thereof; and, FIG. 3 is an end view thereof.

The dryer drum 11 has a plurality of projecting paddles 28, shown generally in FIG. 2, that are attached to and project longitudinally and radially outwardly from the back end 13 of the drum 11. These paddles 28 rotate with the drum 11 and sweep the hot asphalt aggregate that falls from the drum's back opening 18 onto the shroud 20 into either the first discharge opening 24 or the second discharge opening 25, whichever is opened.

As noted previously, the purpose of the mixer drum 51 is to mix the various components used for making the final asphalt product. This separate and distinct mixer drum 51 is both rotatable and cylindrical in shape. The drum 51 has a generally closed front end 52 and a generally open back end 53. This drum 51 may also be insulated so that the contents stay hot therein.

The hot asphalt aggregate that exits the dryer drum 11 through the first discharge opening 24 in the shroud and falls into a hopper 96 which feeds into a channel 97 is introduced into the mixer drum 51 through an inlet opening 54 that is in the front end 52. Reclaimed asphalt pavement ("RAP") can also be introduced into the mixer drum 51 through the inlet opening 54. Specifically, the RAP brought to the assembly by conveyor 96A (FIG. 3) is fed into the hopper 96 and mixes with the hot, dry asphalt aggregate. This premixed mixture moves through the channel 97 into the mixer drum 51 via the front opening 54.

The same inlet opening 54 for the RAP permits the delivery of liquid asphalt into the mixer drum 51 by an asphalt conduit 93. This asphalt conduit 93 feeds into a nozzle 93A which permits the liquid to be fed into the mixer drum 51. Similarly, this inlet opening 54 for the RAP permits the delivery of fines into the mixer drum 51 by a fines conduit 94.

As with the dryer drum 11, a plurality of flights 57 (FIG. 3) abut the interior of the mixer drum 51 so that while the drum rotates the flights 57 lift and drop the contents within the drum. Specifically, these mixer flights 57 may be constructed so as to move the contents within the drum 51 rearwardly, or, alternatively, the drum may be inclined so that rearward movement is by gravity. Further, both directional flights and an inclined drum may be employed.

A discharge opening 58 is located in the back end 53 of the mixer drum 51 for permitting the exit of the final, mixed asphalt product. A closed, stationary housing 30, like the dryer drum shroud 20, is positioned partially over the back end 53 of the mixer drum 51. This end housing 30 extends longitudinally around the back portion of the rotating mixer drum 51. The end housing 30 also has a generally closed back end.

A housing discharge opening 31 is provided in the bottom portion of the end housing 30 near the back end 53 of the mixer drum 51 for discharging the final, mixed asphalt product. Like the dryer drum 11, the mixer drum 51 has a plurality of projecting paddles, generally designated by reference numeral 32, that are attached to and project longitudinally and radially outwardly from the back end 53 of the drum 51. These paddles 32 rotate with the drum 51 and sweep the final asphalt product that falls from the drum's discharge opening 58 onto the end housing 30 into the housing discharge opening 31.

A slat conveyor 91A beneath the discharge 58 catches and transports the discharged asphalt product to mix silos (not shown) for storage and future use or directly to trucks for immediate use.

While it is appreciated that the mixer drum 51 can be supported by and rotated by trunnions like the dryer drum 11, it has been found that because of the relatively small size of the mixer drum, it can be rotated more efficiently by other means, such as a gear drive, chain drive or direct drive with a gear box mounted on the shaft. In the preferred embodiment, the mixer drum 51 is preferably rotated by a motor 81 having a drive sprocket 82 connected by a chain to a driven sprocket 84 having teeth (not shown) secured to the exterior of the mixer drum. Thus, when the motor 81 turns the drive sprocket 82 to drive the chain, driven sprocket 84 will drive the mixer drum 51. However, because the mixer drum is devoid of any obstacles in its interior's center, a central shaft 61 extends longitudinally through this drum. This shaft rotates about and is supported by an inner support bearing 62, located inside the drum adjacent the front end 52, and an outer support bearing 63, located outside the drum near the back end 53. The shaft 61 passes through the end housing 30.

While a conduit alone can be used, it is preferably to have a scavenger fan 95 is interposed between the back end 13 of the dryer drum 11 and the back end 53 of mixer drum 51 for capturing and drawing smoke, steam and dust particles discharged from the mixer drum through a conduit 99A and for feeding the smoke, steam and particles through a conduit 99B into the dryer drum and into the housing 48 that contains the flame introduced by the industrial burner 41. Specifically, the scavenger fan 95 is connected to the end housing 30. There is an aperture 98 in the end housing for permitting the smoke, steam and dust particles passing through the mixer drum's back opening 58 to be drawn out by the scavenger fan 95. The smoke, steam and particles blown in the flame within the housing 48 are incinerated. The shroud 20 also includes an opening 27A for permitting the conduit 99B from the scavenger fan 95 therethrough.

While the specific embodiments have been illustrated and described, numerous modifications come to mind without significantly departing from the spirit of the invention and the scope of protection is only limited by the scope of the accompanying claims.

We claim:

1. An asphalt manufacturing assembly comprising:

a rotatable cylindrical dryer drum having a first end and a second end including a first materials passage means generally positioned at said first end for receiving aggregate, and a second materials passage means generally positioned at said second end for discharging heated aggregate;

means for moving said aggregate within said dryer drum from said first end to said second end;

burner means generally positioned at said second end for introducing a flame and heat into said dryer drum;

air intake means generally positioned at said second end for introducing combustion air into said dryer drum for said burner means;

exhaust means for permitting the escape of steam and the products of combustion from said dryer drum;

a separate rotatable cylindrical mixer drum spaced externally apart from and separate from said dryer drum having a first end and a second end including a first materials passage means generally positioned at said first end for introducing aggregate discharging from said dryer drum, a second materials passage means generally positioned at said first end for introducing liquid asphalt into said mixer drum, and a third materials passage means generally positioned at said first end for introducing fines into said mixer drum;

a discharge passage means generally positioned at said second end for permitting the discharge of the asphalt mix;

means for mixing and moving the contents within said mixer drum from said first end to said second end; and, scavenger means for capturing smoke, steam and dust particles discharged from said mixer drum and for feeding said smoke, steam and dust particles into said dryer drum and said flame introduced by said burner.

2. The asphalt manufacturing assembly as set forth in claim 1 in which said mixer drum further includes means for introducing reclaimed asphalt pavement into said mixer drum at said first end.

3. The asphalt manufacturing assembly as set forth in claim 1 in which said air intake means is a longitudinal air conduit formed by a stationary annular shroud around a portion of said second end of said dryer drum that extends beyond the second end of said dryer drum, said shroud having a generally closed back end, said burner means extending through said shroud into said dryer drum.

4. The asphalt manufacturing assembly as set forth in claim 3 in which said shroud includes a first discharge opening for directing heated aggregate discharged from said dryer drum to said mixer drum and a second discharge opening for directing heated aggregate discharged from said dryer drum to a separate facility, said first and second discharge openings in said shroud being controllable so that said materials discharged from said dryer drum can be directed through said first discharge opening or said second discharge opening.

5. The asphalt manufacturing assembly as set forth in claim 3, further including an end housing around a portion of said second end of said mixer drum that extends beyond said second end of said mixer drum, said end housing having a discharge opening therein.

6. The asphalt manufacturing assembly as set forth in claim 5, further including a plurality of longitudinally and radially projecting paddles attached to said second end of said dryer drum and said mixer drum for sweeping the discharge of each drum.

7. The asphalt manufacturing assembly as set forth in claim 1 in which said means for moving the contents within said mixer drum is a trunnion contacting a circumferential track fixedly secured to the exterior of said mixer drum, said mixer drum further having internal flights.

8. An asphalt manufacturing assembly comprising:

a rotatable cylindrical dryer drum having a first end and a second end including a first materials passage means generally positioned at said first end for receiving aggregate, and a second materials passage means generally positioned at said second end for discharging heated aggregate;

means for moving said aggregate within said dryer drum from said first end to said second end;

burner means generally positioned at said second end for introducing a flame and heat into said dryer drum;

air intake means generally positioned at said second end for introducing combustion air into said dryer drum for said burner means;

exhaust means for permitting the escape of steam and the products of combustion from said dryer drum;

a separate rotatable cylindrical mixer spaced apart from and separated from said dryer drum having a first end and a second end including a first materials passage means generally positioned at said first end for introducing aggregate discharging from said dryer drum, a second materials passage means generally positioned at said first end for introducing liquid asphalt into said mixer drum, and a third materials passage means generally positioned at said first end for introducing fines into said mixer drum;

a discharge passage means generally positioned at said second end for permitting the discharge of the asphalt mix;

means for mixing and moving the contents within said mixer drum from said first end to said second end;

said means for introducing reclaimed asphalt pavement into said mixer drum being said first materials passage means; and, means for introducing reclaimed asphalt pavement into said mixer drum at said first end;

scavenger means for capturing smoke, steam and dust particles discharged from said mixer drum and for feeding said smoke, steam and dust particles into said dryer drum and said flame introduced by said burner.

9. The asphalt manufacturing assembly as set forth in claim 8 wherein said first materials passage means includes a hopper so that said discharged aggregate and said reclaimed asphalt pavement are premixed before introduction into the mixer drum.

10. An asphalt manufacturing assembly comprising:

a rotatable cylindrical dryer drum having a first end and a second end including a first materials passage means generally positioned at said first end for receiving aggregate, and a second materials passage means generally positioned at said second end for discharging heated aggregate;

means for moving said aggregate within said dryer drum from said first end to said second end;

burner means generally positioned at said second end for introducing a flame and heat into said dryer drum;

air intake means generally positioned at said second end for introducing combustion air into said dryer drum for said burner means;

exhaust means for permitting the escape of steam and the products of combustion from said dryer drum;

a separate rotatable cylindrical mixer drum having a first end and a second end including a first materials passage means generally positioned at said first end for introducing aggregate discharging from said dryer drum, a second materials passage means generally positioned at said first end for introducing liquid asphalt into said mixer drum, and a third materials passage means generally positioned at said first end for introducing fines into said mixer drum;

a discharge passage means generally positioned at said second end for permitting the discharge of the asphalt mix;

a motor having a connecting sprocket which rotates and engaging a chain, said chain connected to said mixer drum and causing said drum to rotate, said mixer drum having internal flights and being supported by a longitudinal shaft with each end thereof being supported by a mixer support bearing; and, scavenger means for capturing smoke, steam and dust particles discharged from said mixer drum and for feeding said smoke, steam and dust particles into said dryer drum and said flame introduced by said burner.

11. The asphalt manufacturing assembly as set forth in claim 10 in which said air intake means is a longitudinal air conduit formed by a stationary annular shroud around a portion of said second end of said dryer drum that extends beyond said second end of said dryer, said shroud having a generally closed back end, said burner means extending through said shroud into said dryer drum.

12. The asphalt manufacturing assembly as set forth in claim 11 in which said burner means is a burner extending through said shroud into said dryer drum, said burner having a burner blower secured thereto at one end thereof and a nozzle secured thereto at the other end thereof.

13. The asphalt manufacturing assembly as set forth in claim 12 in which said scavenger means includes a scavenger fan that draws the smoke, steam and dust particles discharged from said mixer drum and blows them into said flame introduced by said burner in said dryer drum.

14. An asphalt manufacturing assembly comprising:

a first and a second rotatable cylindrical drum spaced apart from and separate from each other, each said drum having a first end and a back end including means for moving the contents inside each said drum from said front end towards said back end;

means for introducing aggregate in said first drum;

burner means for introducing a flame and heat into said first drum opposite the movement of said aggregate;

air supply means for introducing air to said burner means;

a longitudinal air passageway leading into said first drum formed by a stationary shroud around a portion of said first drum, said shroud extending longitudinally beyond said back end of said first drum;

means in said first drum for discharging said aggregate onto said shroud from said first drum;

primary means in said shroud for discharging said aggregate into said second drum;

secondary means in said shroud for discharging said aggregate into a separate storage facility;

means in said second drum for receiving said aggregate discharged from said shroud;

means for introducing liquid asphalt into said second drum;

means for introducing fines in said second drum;

means for introducing reclaimed asphalt pavement in said second drum;

means for discharging said asphalt mix from said second drum; and, scavenger means for drawing smoke, steam and dust particles discharged from said second drum and feeding said smoke, steam and dust particles into said first drum and said flame for incineration.

15. The asphalt manufacturing assembly as set forth in claim 14, further including an end housing around the back portion of said second drum that extends beyond the back end of said second drum, said end housing having a discharge opening therein.

16. The asphalt manufacturing assembly as set forth in claim 15, further including a plurality of longitudinally and radially projecting paddles attached to said back end of said first cylinder and said second cylinder for sweeping the discharge of each said cylinder.

17. The asphalt manufacturing assembly as set forth in claim 14, in which said scavenger means includes a scavenger fan that draws the smoke, steam and dust particles discharged from said second drum and blows them into said flame introduced by said burner in said first drum.

18. An asphalt manufacturing assembly comprising:

a rotatable cylindrical dryer drum having a front end and a back end, an opening in said front end for receiving aggregate and for permitting the exhaust of steam and products of combustion, and an opening in said back end for discharging heated aggregate and permitting the introduction of combustion air;

a burner for introducing flame and heat into said dryer drum against the general flow of said contents in said dryer drum;

a longitudinal air conduit formed by a stationary annular shroud around the back portion of said dryer drum for introducing air for said burner means, said shroud extending longitudinally beyond the dryer drum back end;

a first discharge opening in said shroud for directing heated aggregate discharged from said dryer drum into a hopper, a second discharge opening in said shroud for directing heated aggregate discharged from said dryer drum to a separate facility, said first and second discharge openings in sad shroud being controllable so that said materials discharged from said dryer drum can be directed through either said first discharge opening or said second discharge opening;

a trunnion for rotating said dryer drum, said trunnion having a roller for contacting a circumferential track fixedly secured to the exterior of said dryer drum, said dryer drum having internal flights and being downwardly and rearwardly inclined so that when said drum is rotated the contents move rearwardly therein;

a separate rotatable cylindrical mixer drum spaced apart from and separate from said dryer drum having a generally closed front end and a generally open back end adjacent said back end of said cylindrical dryer drum, said mixer drum including materials inlet means in said mixer front end for receiving aggregate discharged from said dryer drum into said hopper, and for receiving reclaimed asphalt pavement, liquid asphalt and fines, and discharge means for discharging asphalt mix from said mixer drum;

means for rotating said mixer drum, said mixer drum having internal flights to move the contents therein rearwardly and being supported by a longitudinal internal shaft extending out of said mixer drum at one end, each end being supported by a mixer support bearing; and, a scavenger fan interposed between said back end of said dryer drum and said back end of said mixer drum for capturing smoke, steam and dust particles discharged from said mixer drum and for feeding said smoke, steam and dust particles into said dryer drum and said flame introduced by said burner.

19. An asphalt manufacturing assembly comprising:

a rotatable cylindrical dryer drum having a first end and a second end including a first materials passage means generally positioned at said first end for receiving aggregate, and a second materials passage means generally positioned at said second end for discharging heated aggregate;

means for moving said aggregate within said dryer drum from said first end to said second end;

burner means adjacent said drum for introducing a flame and heat into said dryer drum;

air intake means generally positioned adjacent said burner means for introducing combustion air into said dryer drum for said burner means;

exhaust means for permitting the escape of steam and the products of combustion from said dryer drum;

a separate rotatable cylindrical mixer drum having a first end and a second end including a first materials passage means generally positioned at said first end for introducing discharging aggregate from said dryer drum, a second materials passage means generally positioned at said first end for introducing reclaimed asphalt pavement into said mixer drum, a third materials passage means generally positioned at said first end for introducing liquid asphalt into said mixer drum, and a fourth materials passage means generally positioned at said first end for introducing fines into said mixer drum;

a discharge passage means generally positioned at said second end for permitting the discharge of the asphalt mix;

means for mixing and moving the contents within said mixer drum from said first end to said second end, said means for mixing and moving the contents within said mixer drum being a motor having a connecting sprocket which rotates and engaging a chain, said chain connected to said mixer drum and causing said drum to rotate, said mixer drum having internal flights and being supported by a longitudinal shaft with each end thereof being supported by a mixer support bearing; and, scavenger means for capturing smoke, steam and dust particles discharged from said mixer drum and for feeding said smoke, steam and dust particles into said dryer drum and said flame introduced by said burner.

20. The asphalt manufacturing assembly as set forth in claim 19 wherein said first materials passage means and said second materials passage means are one conduit that includes a hopper so that said discharged aggregate and said reclaimed asphalt pavement are premixed before introduction into the mixer drum.

21. The asphalt manufacturing assembly as set forth in claim 20 in which said means for mixing and moving the contents within said dryer drum is a trunnion contacting a circumferential track fixedly secured to the exterior of said dryer drum, said dryer drum further having internal flights and being inclined.

* * * * *